US010760590B2

(12) United States Patent
Gebert et al.

(10) Patent No.: US 10,760,590 B2
(45) Date of Patent: Sep. 1, 2020

(54) FLOW STRAIGHTENER

(71) Applicant: EBM-PAPST MULFINGEN GMBH & CO. KG, Mulfingen (DE)

(72) Inventors: Daniel Gebert, Am Rain (DE); Thorsten Pissarczyk, Gemmingen (DE); Sebastian Hoss, Bad Mergentheim (DE)

(73) Assignee: EBM-PAPST MULFINGEN GMBH & CO. KG, Mulfingen (DE)

( * ) Notice: Subject to any disclaimer, the term of this patent is extended or adjusted under 35 U.S.C. 154(b) by 247 days.

(21) Appl. No.: 15/560,027

(22) PCT Filed: Mar. 22, 2016

(86) PCT No.: PCT/EP2016/056278
§ 371 (c)(1),
(2) Date: Jan. 17, 2018

(87) PCT Pub. No.: WO2016/150975
PCT Pub. Date: Sep. 29, 2016

(65) Prior Publication Data

US 2018/0216630 A1 Aug. 2, 2018

(30) Foreign Application Priority Data

Mar. 25, 2015 (DE) ..... 10 2015 205 424

(51) Int. Cl.
*F04D 29/54* (2006.01)
*F04D 19/00* (2006.01)
(Continued)

(52) U.S. Cl.
CPC ..... *F04D 29/542* (2013.01); *F04D 19/002* (2013.01); *F04D 25/06* (2013.01);
(Continued)

(58) Field of Classification Search
CPC .. F05D 2260/36; F05D 2230/51; F04D 29/54; F04D 29/541; F04D 29/542; F04D 29/644; F04D 29/646; F04D 19/002
(Continued)

(56) References Cited

U.S. PATENT DOCUMENTS 3,883,264 A 5/1975 Rao
4,548,548 A * 10/1985 Gray, III ..... F01P 5/06 123/41.49

(Continued)

FOREIGN PATENT DOCUMENTS

CN 2833194 11/2006
EP 140823 11/1986

(Continued)

OTHER PUBLICATIONS

English Translation of PCT/EP2016/056278 International Preliminary Report on Patentability dated Jun. 20, 2017.

*Primary Examiner* — Kenneth J Hansen
*Assistant Examiner* — Maranatha Boardman
(74) *Attorney, Agent, or Firm* — Tarolli, Sundheim, Covell & Tummino LLP

(57) ABSTRACT

The invention relates to a flow rectifier for an axial fan as well as to an axial fan having a flow rectifier. A flow rectifier according to the invention for an axial fan with a hub and at least one vane is characterized in that the at least one vane can be operatively connected to the hub so as to be detachable. Since the vane and the hub can be connected so as to be detachable, the flow rectifier has a modular structure.

15 Claims, 4 Drawing Sheets

(51) Int. Cl.
*F04D 29/64* (2006.01)
*F04D 25/06* (2006.01)
*F04D 29/66* (2006.01)

(52) U.S. Cl.
CPC ..... *F04D 29/646* (2013.01); *F04D 29/667* (2013.01); *F05D 2230/51* (2013.01); *F05D 2260/36* (2013.01)

(58) Field of Classification Search
USPC ..... 415/209.2–209.4
See application file for complete search history.

(56) References Cited

U.S. PATENT DOCUMENTS 5,249,921 A * 10/1993 Stueber ..... F04D 29/542 415/138
6,409,472 B1 6/2002 McMahon et al.
7,040,862 B2 * 5/2006 Otsuka ..... F04D 29/542 415/214.1
7,275,911 B2 * 10/2007 Lee ..... F04D 25/0613 415/211.2
7,442,010 B2 * 10/2008 Gruber ..... F04D 25/0613 416/169 A
9,897,094 B2 * 2/2018 Kang ..... F04D 25/0613
9,932,990 B2 * 4/2018 Schone ..... F04D 29/541
10,107,306 B2 * 10/2018 Haaf ..... F24F 13/20
2007/0122274 A1 5/2007 Moorman et al.
2013/0209294 A1 * 8/2013 Iwamoto ..... F04D 25/08 417/423.14
2015/0252812 A1 * 9/2015 Sauer ..... F04D 25/08 417/423.14
2015/0330411 A1 11/2015 Heli
2018/0106267 A1 * 4/2018 Gebert ..... F04D 19/002

FOREIGN PATENT DOCUMENTS

JP 20122031750 3/1996
WO 2009105208 A2 8/2009
WO WO 2011/101440 8/2011
WO 2013115349 A1 8/2013
WO 2014056657 A4 4/2014

* cited by examiner

FLOW STRAIGHTENER

RELATED APPLICATION

This application filed under 35 U.S.C. § 371 is a national phase application of International Application Serial Number PCT/EP2016/056278 filed Mar. 22, 2016, which claims priority to European Patent Application No. EP 10 2015 424.1, filed on Mar. 25, 2015, the disclosure of which is entirely incorporated herein by reference.

TECHNICAL FIELD

The invention relates to a flow rectifier for an axial fan as well as to an axial fan having a flow rectifier.

In this context, the term "flow rectifier" refers to a baffle element, whereby this baffle element, which is arranged as a flow rectifier downstream from an axial fan, diverts the air that has been made to flow by the axial fan impeller so as to establish a flow that is as axial and uniform as possible. For this purpose, the flow rectifier has at least one appropriately shaped baffle vane.

BACKGROUND ART

Fans with large diameters require large flow rectifiers. Such large flow rectifiers, whose parts have diameters of 350 mm, especially of more than 500 mm, are expensive: for cost reasons, these parts are usually made of plastic, for example, by means of injection molding. This calls for injection molding tools that entail high tool costs, especially in the case of large parts. Moreover, production by means of plastic injection molding is quite difficult with such large parts, particularly in view of their thin walls. The parts are basically fragile and problematic when it comes to packaging, storage, transportation and handling.

International patent application WO 2014/056657 of the applicant discloses a flow rectifier as well as an axial fan, especially for evaporators in cold-storage rooms. The flow rectifier downstream from the axial fan greatly increases the range of throw of the axial fan, a process in which it converts the swirling outflow of the fan into a uniform axial flow. In this context, the term "range of throw" refers to a distance up to which a limit speed of the air flow is maintained. The flow rectifier is made as a one-piece injection-molded plastic part. Subsequently, it can be detachably mounted as a separate part onto a wall ring or onto a safety grille or support grille of a fan.

Depending on the operating point of the fan, it is advantageous in terms of the throughput rate and the efficiency to use flow rectifiers that have a varying number of baffle vanes, whereby the baffle vanes advantageously have different geometries, depending on the operating point of the fan. As a result, the required production run for a specific flow rectifier is smaller than that of the corresponding fan and thus especially too small for a cost-effective production run, since a separate injection mold is needed for each variant of the flow rectifier.

The documents European patent application EP 1 408 238 A2, U.S. Pat. Nos. 3,883,264, 6,409,472 B1 and Japanese patent specification JP 2012031750 each disclose a flow rectifier for an axial fan, having a hub and at least one vane, whereby the at least one vane can be operatively connected to the hub so as to be detachable. It is also disclosed that the hub forms a cup with a bottom, an inner circumferential wall and an outer circumferential wall, whereby the hub cup has an opening in the hub bottom.

The objective of the invention is to put forward an axial fan with an optional flow rectifier, whereby it should be possible to optimize the geometry of the cost effectively producible flow rectifier for various operating points.

This objective is achieved by an axial fan according to the claims. Advantageous embodiments of the axial fan can be gleaned from the claims.

DISCLOSURE OF THE INVENTION

A flow rectifier according to the invention for an axial fan with a hub and at least one vane is characterized in that the at least one vane can be operatively connected to the hub so as to be detachable. Since the vane and the hub can be connected so as to be detachable, the flow rectifier has a modular structure. Depending on the operating point of the axial fan, more or fewer vanes can be used. Here, the flow rectifier can also have numerous vanes. The vane geometry can also be easily changed. Furthermore, different flow rectifiers are needed for different fan sizes, that is to say, for fans with different impeller diameters. Due to the modular structure, the hub of the flow rectifier can be used for different fan sizes in that various guide vanes are attached to the hub. This increases the production run for the hubs, so that economies of scale result in lower part costs and less capital expenditure. Since the flow rectifier consists of several parts, the size of the individual parts is reduced, leading to lower tool costs and facilitating the injection-molding process. By the same token, packaging, storage, transportation and handling are greatly simplified.

It has proven to be advantageous if the hub forms a cup with a bottom, an inner circumferential wall and an outer circumferential wall, whereby the hub cup has an opening in the hub bottom. Particularly when the opening is in the lowest point of the hub cup, water is prevented from accumulating in the hub cup. Moreover, a visual inspection can be made through the opening in order to check, for example, whether the positive connection between the at least one guide vane and the hub was established correctly.

It has also proven to be advantageous if the at least one vane can be operatively connected to the hub without the need to use tools. Here, the at least one vane can be operatively connected to the hub positively and/or non-positively. For example, by means of a special geometry on the hub-side end of the at least one vane, the at least one vane can be operatively connected to the hub and to the corresponding counterpart of this geometry on the outer circumference of the hub. This special geometry can advantageously be configured as a dovetail guide.

It has proven to be especially advantageous if the operative connection of the at least one vane can be additionally secured onto the hub. For example, the at least one vane can be additionally latched onto the hub. This can be effectuated, for example, in that the vane has a guide with which it can be inserted into the hub. For this purpose, the outer circumference of the hub likewise has corresponding guides. The inside of this guide, i.e. the side facing the center axis of the axial fan, can have a latching hook that faces this side and that can be latched behind a corresponding edge of the hub. In order to increase the flexibility, the guide can have a slit, as a result of which the requisite joining force is minimized. Thanks to the latching, a secure connection is established between the vane and the hub of the flow rectifier.

In another advantageous embodiment, on the inside circumferential wall, the hub has a stop facing the center axis, that is to say, the axis of rotation of the impeller.

An axial fan according to the invention has an impeller powered by an electric motor, a diffuser, a flow rectifier, a support structure and at least one circumferential ring, whereby the support structure and the at least one circumferential ring are arranged downstream from the impeller, and whereby the flow rectifier can be attached to the at least one circumferential ring. The axial fan can be installed via a wall ring in an appropriate opening in a wall. The support structure then creates the connection between the wall ring and the electric motor, securing the electric motor and thus the impeller in the wall ring. One or more circumferential concentric rings or at least one spiral ring can be attached to the support structure, above which there can be a guard against accidental contact in the form of a safety grille for the impeller and/or for electric parts of the motor. As an alternative, if necessary, the guard against accidental contact, can be in the form of a separate safety device.

A flow rectifier increases the peak efficiency of an axial fan in the high pressure range of the characteristic curve of the fan. At low counterpressures and high volume flows, however, the efficiency of a fan having a flow rectifier is lower. The flow rectifier according to the invention can optionally be integrated whenever this is advantageous for the area of application in question. No change needs to be made to the existing parts in order to be able to attach the flow rectifier.

Moreover, it has proven to be advantageous if the at least one vane has a connection element in an area facing away from the hub. The flow rectifier can be connected to the support structure and/or to the safety grille via the connection element. Here, the support structure and/or the safety grille contribute to the stability of the flow rectifier.

In an especially advantageous embodiment, the flow rectifier can be operatively connected to the at least one circumferential ring without the need to use tools. As a result, the flow rectifier can be very easily installed on the axial fan, if the operating point requires this, and it can be removed again if the flow rectifier is not needed at another operating point. Here, the flow rectifier can be attached to the at least one circumferential ring positively and/or non-positively by means of the connection element. Such an attachment is possible, for example, via an elastic-plastic deformation of the connection element. Here, the connection element is deformed partially elastically, but also partially plastically.

In another especially advantageous embodiment, the support structure has a flange ring on its side facing the axis of rotation of the impeller, whereby the flow rectifier can be operatively connected to the flange ring positively and/or non-positively. For example, the flow rectifier can be operatively connected to the flange ring via a latching hook. This connection additionally increases the endurance limit of the flow rectifier.

It has also proven to be advantageous for the stop of the hub to cooperate with the flange ring of the support structure and with the latching hook in the installed state in such a way that the axial position of the flow rectifier is fixed. The stop can have a labyrinth-like configuration. As a result, the stop reduces the leakage flow in the connection area. The stop is only interrupted in the area of the latching hooks for production-related reasons.

Moreover, it has proven to be particularly advantageous if a gap is formed in the circumferential direction between the diffuser and the at least one vane. As an alternative, the end face of the at least one vane facing in the circumferential direction can also touch the diffuser.

Additional advantages, special features and practical refinements of the invention can be gleaned from the subordinate claims and from the presentation below of preferred embodiments making reference to the drawings.

DETAILED DESCRIPTION

Figure 1:
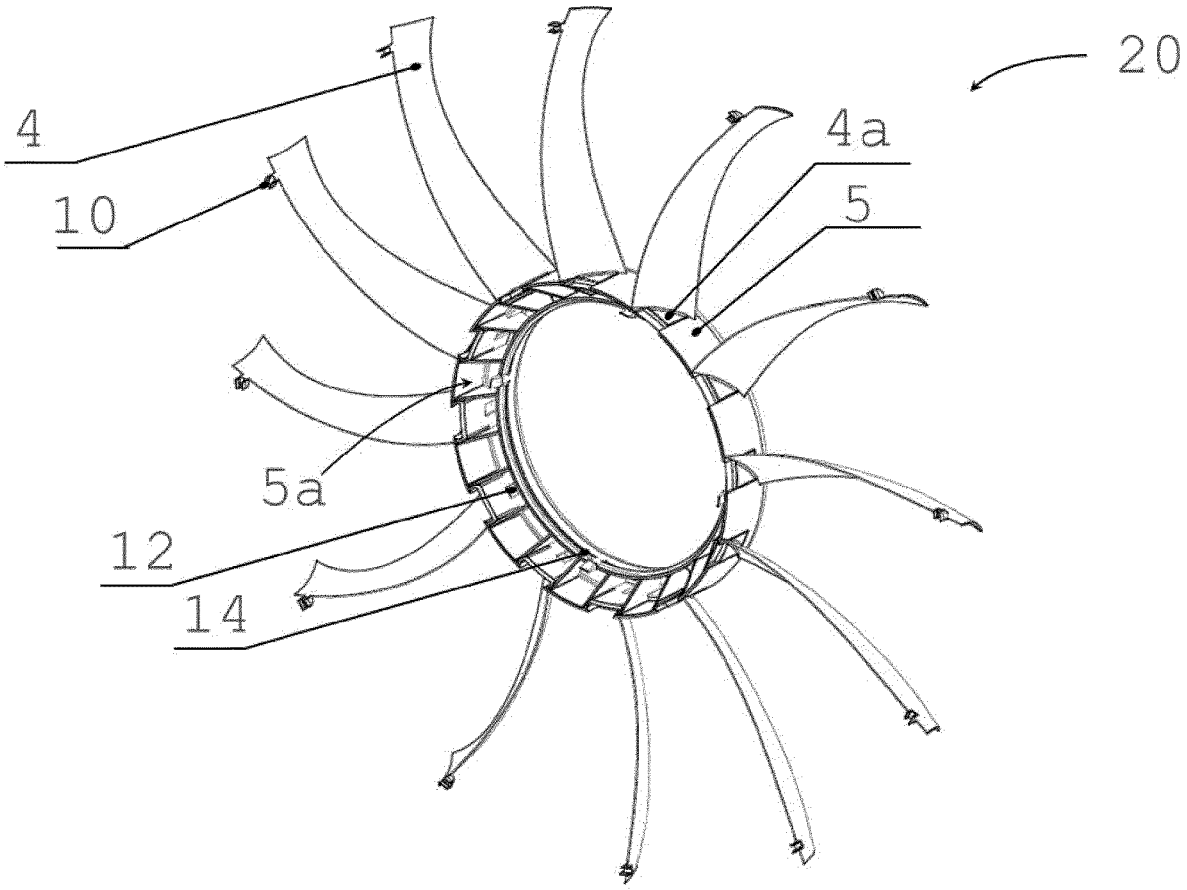
FIG. 1 a flow rectifier according to the invention, in a three-dimensional view, FIG. 2 a section of a flow rectifier according to the invention, in a cross section, FIG. 3 a section of an axial fan according to the invention with an installed flow rectifier, in a cross sectional view, FIG. 4 another section of an axial fan according to the invention, with an installed flow rectifier, in a cross sectional view.

FIG. 1 shows a flow rectifier 20 according to the invention, in a three-dimensional view. The flow rectifier 20 has a hub 5 and a plurality of vanes 4. The inner circumference of the hub 5 has a circumferential stop 14 as well as latching hooks 12 distributed along the circumference. On their ends facing the center axis 2*a* of the hub, the vanes 4 have guides 4*a* by means of which they are inserted along the outer circumference of the hub 5 into guides 5*e* located there (not visible in this figure). In particular, in this manner, the vanes 4 can be connected to the hub 5 without the need to use tools. Moreover, the vanes 4 each have a connection element 10 in an area on their side facing away from the center axis 2*a* of the hub.

Figure 2:
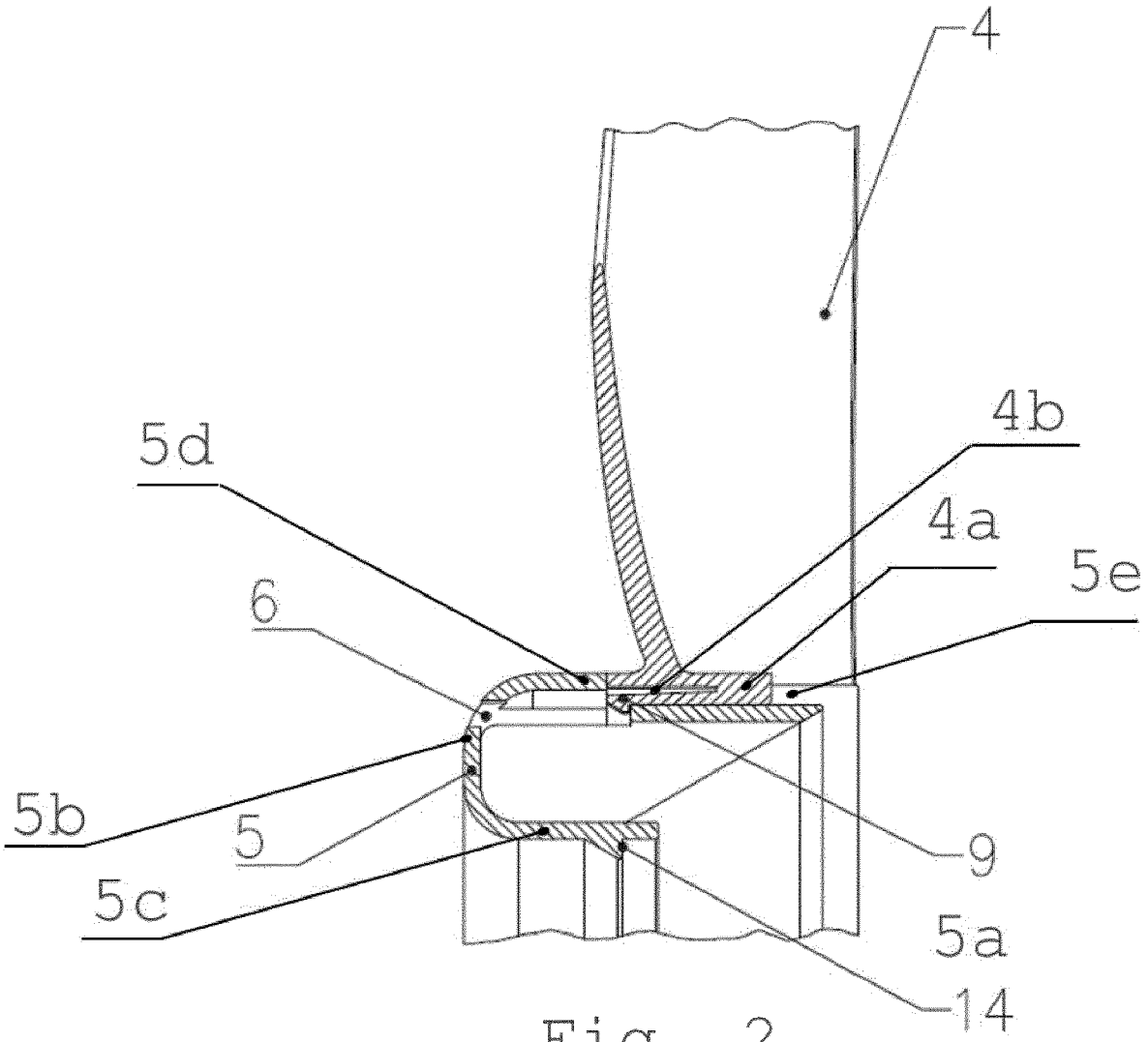

FIG. 2 shows a section of a flow rectifier according to the invention, in a cross section. A vane 4 is inserted with its guide 4*a* into the corresponding counterpart of the geometry, namely, the guide 5*e* of the hub 5. The guides 4*a* and 5*e* are configured as a dovetail guide. The hub 5 has a bottom 5*b*, an inner circumferential wall 5*c* and an outer circumferential band 5*d*, and it forms a hub cup 5*a*. In the hub bottom 5*b*, there is an opening 6 through which the water that might accumulate in the bare cup 5*a* can drain. The guide 5*b* is situated in the outer circumferential band 5*d*. The guide 4*a* of the vane 4 has a slit 4*b* that is open towards the hub bottom 5*b*. This slit 4*b* increases the flexibility of the guide 4*a*. The guide 4*a* has a latching hook 9 on its end facing the hub bottom 5*b*. When the guide 4*a* of the vane 4 is completely inserted, this latching hook 9 snaps into the guide 5*e* of the hub behind the wall of the guide 5*e*, thus securing the vane 4 in the hub 5. The inner circumferential wall 5*c* has a stop 14 facing the center axis 2*a*.

Figure 3:
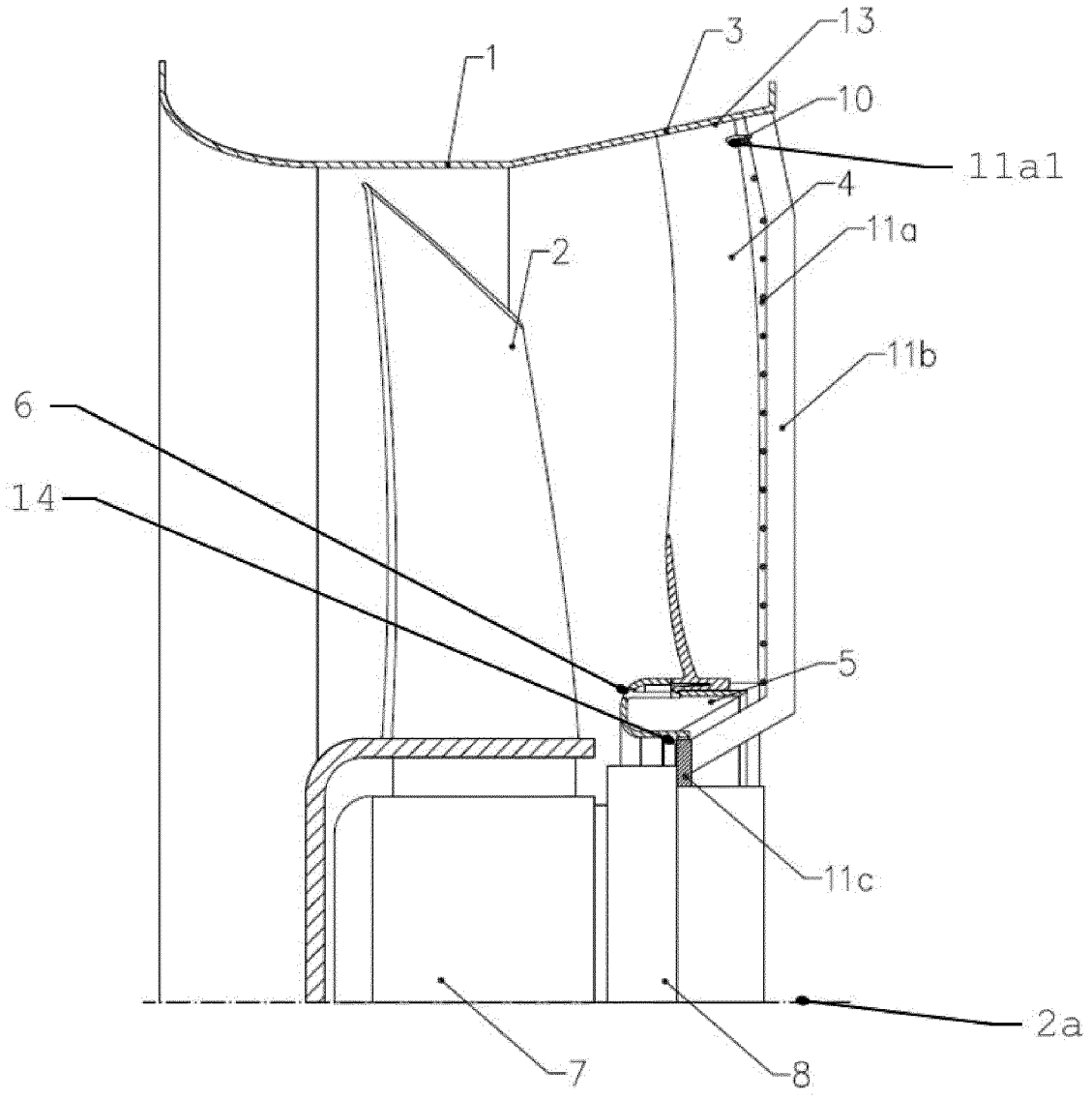

FIG. 3 shows a section of an axial fan according to the invention, with an installed flow rectifier 20 in a cross sectional view. The axial fan has an impeller 2 that can be powered by an electric motor, a diffuser 3, a flow rectifier 20, a support structure 11*b* and at least one circumferential ring 11*a*1, whereby the support structure 11*b* and the at least one circumferential ring 11*a*1 are arranged downstream from the impeller as seen in the direction of flow, and whereby the flow rectifier 20 can be attached to the at least one circumferential ring 11*a*1. The axial fan can be installed via a wall ring 1 in an appropriate opening in a wall. The support structure 11*b* then establishes the connection between the wall ring 1 and the electric motor, securing the electric motor and thus the impeller 2 in the wall ring 1. One or more circumferential concentric rings 11*a* are attached to the support structure 11*b*, above which there can be a guard against accidental contact in the form of a safety grille for the impeller 2 and/or for electric parts of the motor.

The flow rectifier 20 can optionally be integrated, that is to say, it can be attached to the axial fan, if this is advantageous for the area of application in question. For a different operating point, however, the flow rectifier 20 can also be easily removed again. In particular, the flow rectifier 20 can be attached and removed again without the need to use tools. No changes need to be made to the existing components in order to be able to attach the flow rectifier 20. By means of the connection element 10, the flow rectifier 20 can be attached to the support structure 11*b* via the at least one circumferential ring 11*a*1. Here, the support structure 11*b* contributes to the stability of the flow rectifier 20. The flow rectifier 20 can be attached to the at least one circumferential ring 11*a*1 positively or non-positively by means of the connection element 10 in that the fork-like fastening element 10 is slid onto the at least one circumferential ring 11*a*1. Here, the connection element 10 is deformed partially elastically, but also partially plastically.

Figure 4:
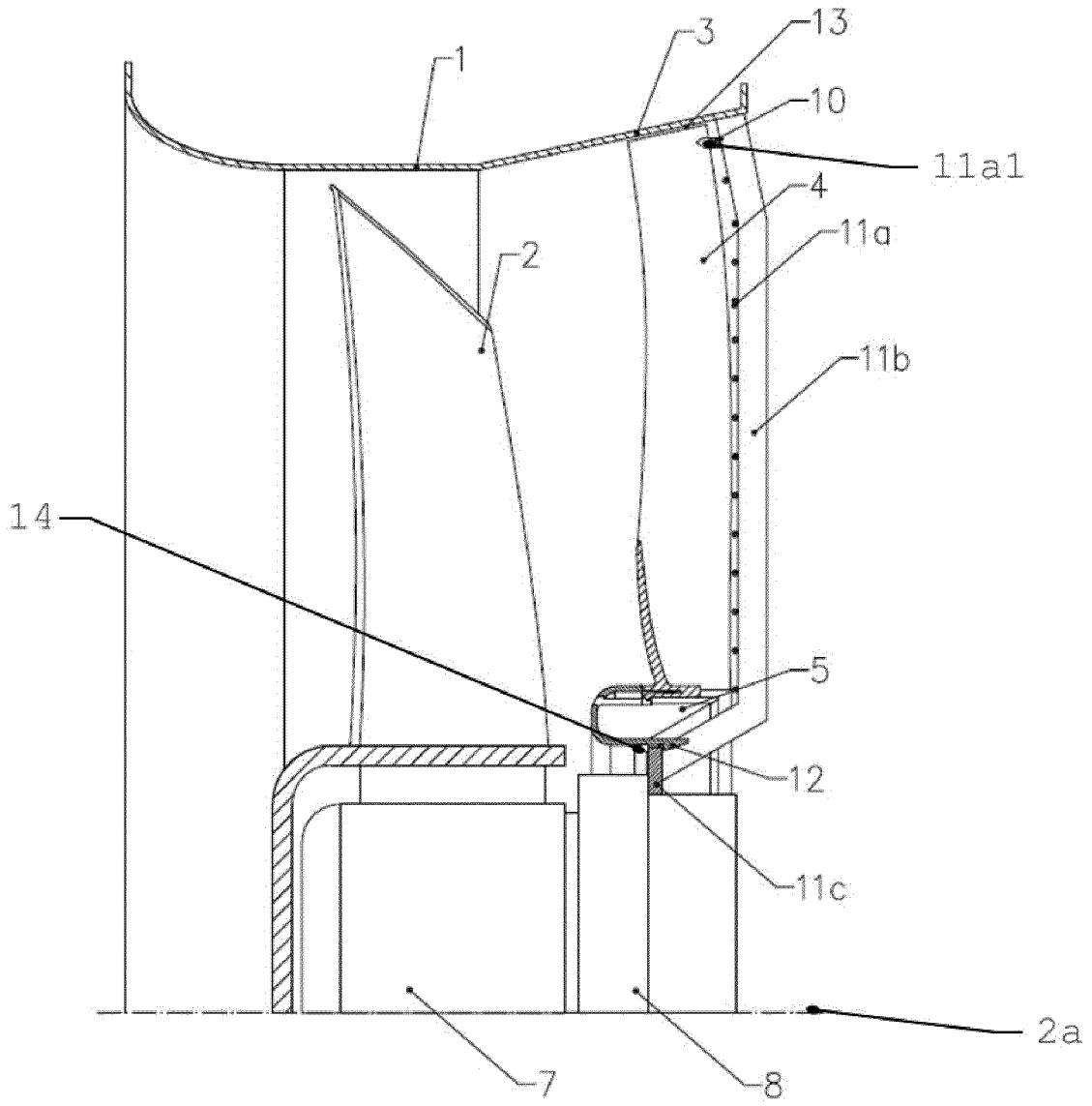

FIG. 4 shows another section of an axial fan according to the invention, with an installed flow rectifier 20, in a cross sectional view.

The support structure 11*b* has a flange ring 11*c* on its side facing the axis of rotation 2*a* of the impeller 2, whereby the flow rectifier 20 is operatively connected to the flange ring via a latching hook 12. This connection additionally increases the endurance limit of the flow rectifier 20.

The hub 5 is pressed onto the support structure 11*b* all the way to the stop 14 of the inner circumferential wall 5*c*, whereby the inner circumferential wall 5*c* snaps onto the flange ring 11*c* of the support structure 11*b*. As a result, the axial position of the flow rectifier 20 is fixed. The stop 14 has a labyrinth-like configuration, as a result of which the leakage flow in the connection area is reduced. The stop 14 is only interrupted in the area of the latching hooks 12 for production-related reasons.

A gap 13 is formed in the circumferential direction between the diffuser 3 and the at least one vane 4.

The embodiments presented here are merely examples of the present invention and thus must not be construed in a limiting fashion. Alternative embodiments taken into consideration by the person skilled in the art are equally encompassed by the scope of protection of the present information.

LIST OF REFERENCE NUMERALS

1 wall ring
2 impeller
2*a* axis of rotation of the impeller, center axis
3 diffuser
4 vane
4*a* guide
4*b* slit
5 hub
5*a* hub cup
5*b* hub bottom
5*c* inner circumferential wall
5*d* outer circumferential wall
5*e* guide
6 opening
7 rotor
8 stator
9 latching hook
10 connection element
11*a* ring
11*a*1 circumferential ring
11*b* support structure
11*c* flange ring
12 latching hook
13 gap
14 stop
20 flow rectifier

The invention claimed is:

1. An axial fan having an impeller that can be powered by an electric motor, a diffuser, a flow rectifier with a hub and at least one vane, whereby the at least one vane can be operatively connected to the hub so as to be detachable, and the hub forms a cup with a bottom, an inner circumferential wall running in the radial direction and an outer circumferential wall running in the radial direction, whereby the hub cup has an opening in the hub bottom, and a support structure and at least one circumferential ring, whereby the support structure and the at least one circumferential ring are arranged downstream from the impeller, whereby the flow rectifier can be attached to the at least one circumferential ring, and whereby the support structure has a flange ring on its side facing the center axis of the impeller, whereby the flow rectifier can be operatively connected to the flange ring, and the flow rectifier can be operatively connected to the flange ring via a latching hook, and whereby on the inside circumferential wall, the hub has a stop facing the center axis, wherein the stop of the hub cooperates with the flange ring of the support structure and with the latching hook in the installed state in such a way that the axial position of the flow rectifier is fixed, whereby the at least one vane has a connection element in an area facing away from the hub for connecting the flow rectifier to the at least one circumferential ring.

2. The axial fan according to claim 1 wherein the at least one vane can be operatively connected to the hub.

3. The axial fan according to claim 2 wherein the operative connection of the at least one vane comprises a latching hook on the at least one vane for engaging in a corresponding guide in the hub.

4. The axial fan according to claim 1 wherein the flow rectifier can be attached to the at least one circumferential ring by the connection element.

5. The axial fan according to claim 1 wherein the support structure has the flange ring on its side facing the center axis of the impeller, whereby the flow rectifier can be operatively connected to the flange ring.

6. The axial fan according to claim 1 wherein a gap is formed in a circumferential direction between the diffuser and the at least one vane.

7. The axial fan according to claim 1 wherein an end face of the at least one vane facing in the circumferential direction touches the diffuser.

8. The axial fan according to claim 1, wherein the connection element comprises a fork-like connection element.

9. The axial fan according to claim 1 wherein the connection element comprises a pair of tines separated by an opening for receiving the at least one circumferential ring.

10. The axial fan according to claim 1 wherein each connection element is spaced from the hub and extends away from the impeller.

11. The axial fan according to claim 1 wherein the bottom of the hub spaces the inner circumferential wall from the outer circumferential wall.

12. The axial fan according to claim 1 wherein the support structure is provided downstream of the flow rectifier.

13. The axial fan according to claim 1 wherein the at least one circumferential ring is provided on the support structure.

14. The axial fan according to claim 1 wherein the flange ring is positioned radially inward from the at least one circumferential ring.

15. An axial fan having:

an impeller for rotation about an axis and capable of being powered by an electric motor;

a diffuser having a support structure and at least one circumferential ring provided thereon and arranged downstream from the impeller, the support structure including a flange ring on a side facing the impeller axis; and a flow rectifier including a hub and at least one vane detachably connected thereto, the hub forming a cup having an inner circumferential wall running in the radial direction, an outer circumferential wall running in the radial direction, and a bottom spacing the inner and outer circumferential walls from one another, wherein an opening extends through the hub bottom, wherein the at least one vane has a connection element in an area facing away from the hub for connecting the flow rectifier to the at least one circumferential ring, wherein the inner circumferential wall includes a stop extending radially inwards towards the impeller axis and a latching hook, the flange ring being positioned between the stop and the latching hook to operatively connect the support structure to the flow rectifier such that the axial position of the flow rectifier is fixed.

* * * * *